US006654961B2

(12) United States Patent
Béland

(10) Patent No.: US 6,654,961 B2
(45) Date of Patent: Dec. 2, 2003

(54) ADJUSTABLE LEG PAD ASSEMBLY

(75) Inventor: Jean-François Béland, Montreal (CA)

(73) Assignee: Bauer Nike Hockey Inc., St-Jérôme (CA)

( * ) Notice: Subject to any disclaimer, the term of this patent is extended or adjusted under 35 U.S.C. 154(b) by 0 days.

(21) Appl. No.: 10/158,063

(22) Filed: May 31, 2002

(65) Prior Publication Data

US 2002/0184693 A1 Dec. 12, 2002

(30) Foreign Application Priority Data

Jun. 8, 2001 (CA) ..... 2350157

(51) Int. Cl.[7] ..... A41D 13/06
(52) U.S. Cl. ..... 2/22; 2/911; 602/62
(58) Field of Search ..... 2/22, 23, 24, 455, 2/16, 62, 269, 911; 128/878, 881, 882; 602/5, 16, 20, 23, 26, 62

(56) References Cited

U.S. PATENT DOCUMENTS

| | | | | | |
|---|---|---|---|---|---|
| 1,624,129 | A | * | 4/1927 | Barrett | 2/22 |
| 2,982,968 | A | * | 5/1961 | Groot | 2/22 |
| 3,761,960 | A | * | 10/1973 | Woodcock | 2/22 |
| 4,627,108 | A | | 12/1986 | Järvinen | |
| 4,692,946 | A | * | 9/1987 | Jurga | 2/22 |
| 4,700,406 | A | | 10/1987 | Meistrell | |
| 5,452,475 | A | * | 9/1995 | Hunt, Jr. | 2/22 |
| 5,477,559 | A | | 12/1995 | Clement | |
| 5,507,720 | A | | 4/1996 | Lampropoulos | |
| 5,652,956 | A | | 8/1997 | Hoshizaki et al. | |
| 5,662,594 | A | * | 9/1997 | Rosenblatt | 602/16 |
| 5,732,411 | A | | 3/1998 | Coleman et al. | |
| 5,794,261 | A | | 8/1998 | Hefling | |
| 5,829,055 | A | | 11/1998 | Collins et al. | |
| 5,898,939 | A | * | 5/1999 | Schramm | 2/22 |
| 6,128,779 | A | * | 10/2000 | Goldsmith et al. | 2/22 |
| 6,131,195 | A | * | 10/2000 | Foreman | 2/22 |
| 6,178,556 | B1 | * | 1/2001 | Foreman et al. | 2/22 |
| 6,272,682 | B1 | | 8/2001 | Fullum | |

FOREIGN PATENT DOCUMENTS

| | | |
|---|---|---|
| CA | 647906 | 9/1962 |
| CA | 733239 | 5/1966 |
| DE | 23 62 044 A1 | 12/1973 |
| DE | 41 25 634 C2 | 10/1995 |

* cited by examiner

*Primary Examiner*—Tejash Patel

(57) ABSTRACT

The invention provides an adjustable leg pad assembly comprising a knee shield, a shin shield, a liner, a shield extension, an adjustable liner, and fasteners for joining the adjustable liner and the liner. The liner is fixedly connected to both the knee shield and the shin shield while the shield extension is adjustably mounted on an interior portion of the shin shield and extends from a lower portion of the latter. The adjustable liner, which is adapted to be releasably mounted to the liner, includes connection means to enable its coupling to the shield extension. Moreover, the fasteners are capable of varying the positioning of the liner and the adjustable liner relative to one another.

22 Claims, 4 Drawing Sheets

ADJUSTABLE LEG PAD ASSEMBLY

FIELD OF THE INVENTION

The present invention relates to protective equipment for hockey and other such sporting activities. More specifically, the invention relates to leg pads capable of being adjusted to conform to the anatomies of differently sized players.

BACKGROUND OF THE INVENTION

In recent years, security has become an issue of ever-increasing importance in professional and amateur sports. Sports such as hockey are rapidly evolving and becoming more physically demanding since players tend to be faster and stronger than before. Consequently, protective equipment such as leg pads must also evolve to better suit the needs of today's players Conventional wisdom has to date dictated that hockey leg pads include a flexible padded liner of elongated shape that extends along a front portion of the wearer's leg. The padded liner, more precisely, extends from the ankle to above the knee (note that commonly used jargon such as "shin guards" or "shin pads" are therefore slightly misleading due to the fact that protection of the knee is also provided) and is connected by sewing, riveting, and the like to rigid or semi-rigid shield members such as a rigid plastic knee shield and a rigid plastic shin shield. Straps featuring hooks and loops type fasteners are provided to minimize motion of the leg pad while in use.

A deficiency typically associated with traditional leg pads can be attributed to the growth of young players' limbs. Young players frequently outgrow their equipment from one year to the next. Thus, leg pads which fit a player one year might not necessarily fit the following year. This can result in a potentially hazardous situation since the leg pads used do not offer the level of protection that is frequently required in contact sports such as hockey. The latter problematic is compounded by the fact that leg pads and hockey equipment in general can be fairly expensive. As a result, young players might attempt to keep their leg pads as long as possible.

The use of traditional leg pads in situations other than that described above can also present some risks. Although players of higher caliber, for example, generally possess their own equipment, lower caliber players who play on an infrequent basis are often tempted to borrow or rent equipment rather than purchase it. This situation can become problematic because these players may therefore be using inadequately sized equipment and, as a result, the possibilities of incurring an injury increase.

There is therefore a need in the sports industry for leg pads that can offer enhanced levels of protection and comfort as required by contemporary athletes and that can also be adjusted to better accommodate differently sized players.

SUMMARY OF THE INVENTION

It is an object of the present invention to provide an adjustable leg pad assembly which overcomes some of the disadvantages of the prior art.

In accordance with a first broad aspect, the invention provides an adjustable leg pad assembly comprising a knee shield, a shin shield, an intermediary portion, a liner, a shield extension, an adjustable liner, and fasteners for joining the adjustable liner and the liner. The intermediary portion is positioned between the knee shield and the shin shield while the liner is fixedly connected to the knee shield, the shin shield, and the intermediary portion. The shield extension is adjustably mounted on an interior portion of the shin shield and extends from a lower portion of the latter. The adjustable liner, which is adapted to be releasably mounted to the liner, includes connection means to enable its coupling to the shield extension. Moreover, the fasteners are capable of varying the positioning of the liner and the adjustable liner relative to one another. In a specific example of implementation, the adjustable liner and the shield extension are concurrently movable relative to the liner and the shin shield.

Advantageously, the shield extension is substantially rigid and includes at least one prong, while the connection means include at least one fastening flap that is capable of being folded back in order to define a recess wherein the prong is capable of being inserted, thereby effecting the coupling of the adjustable liner and the shield extension.

Continuing with this example of implementation, the fasteners include hooks and loops fasteners that are respectively disposed along an outer surface of the adjustable liner and an inner surface of the liner. Preferably, the hooks and loops fasteners are of elongated shape.

Advantageously, the adjustable leg pad assembly comprises guiding means to direct the relative positioning of the shield extension and the shin shield. More specifically, the guiding means include a slot which is located on the shield extension and which is adapted to sliding receive therein a projection extending from the shin shield. Motion of the projection within the slot results in the variation of the positioning of the adjustable liner and the shield extension relative to that of the shin shield.

Under a second broad aspect, the invention provides an adjustable leg pad assembly comprising a leg pad, a liner, a shield extension, an adjustable liner, and fasteners for joining the adjustable liner and the liner. The liner is fixedly connected to the leg pad while the shield extension is capable of being movably mounted on an interior portion of the leg pad. The adjustable liner, which is adapted to be releasably mounted to the liner, includes connection means that are adapted to enable its coupling to the shield extension. Moreover, the fasteners are capable of varying the positioning of the liner and the adjustable liner relative to one another.

In a specific example of implementation, the adjustable liner and the shield extension are concurrently movable relative to the liner and the shin shield. Advantageously, the shield extension is substantially rigid and includes at least one prong, while the connection means include at least one fastening flap that is capable of being folded back in order to define a recess wherein the prong is capable of being inserted, thereby effecting the coupling of the adjustable liner and the shield extension.

The fasteners include hooks and loops fasteners that are respectively disposed along an outer surface of the adjustable liner and an inner surface of the liner. Preferably, the hooks and loops fasteners are of elongated shape.

Advantageously, the adjustable leg pad assembly comprises guiding means to direct the relative positioning of the shield extension and the leg pad. More specifically, the guiding means include a slot which is located on the shield extension and which is adapted to slidingly receive therein a projection extending from the leg pad. Motion of the projection within the slot results in the variation of the positioning of the adjustable liner and the shield extension relative to that of the leg pad.

Under a third broad aspect, the invention provides an adjustable leg pad assembly comprising a knee shield, a shin shield, an intermediary portion, a liner, a shield extension, and an adjustable liner. The intermediary portion is connected to the knee shield and the shin shield while the liner is fixedly connected to the knee shield, the shin shield, and the intermediary portion. The shield extension is adjustably mounted on an interior portion of the shin shield and extends from a lower portion of the latter. The adjustable liner, which is adapted to be releasably mounted to the liner, includes connection means that enable its coupling to the shield extension.

Under yet another broad aspect, the invention provides an adjustable leg pad assembly comprising a leg pad, a liner, a shield extension, and an adjustable liner. The liner is fixedly connected to the leg pad while the shield extension is adjustably mounted on an interior portion of the leg pad and extends from a lower portion of the latter. The shield extension is also integrally mounted onto the adjustable liner while the adjustable liner is adapted to be releasably mounted to the liner, and includes connection means that enable its coupling to the shield extension.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

A detailed description of the preferred embodiments of the present invention is provided herein below, by way of example only, with reference to the accompanying drawings, in which.

Figure 1:
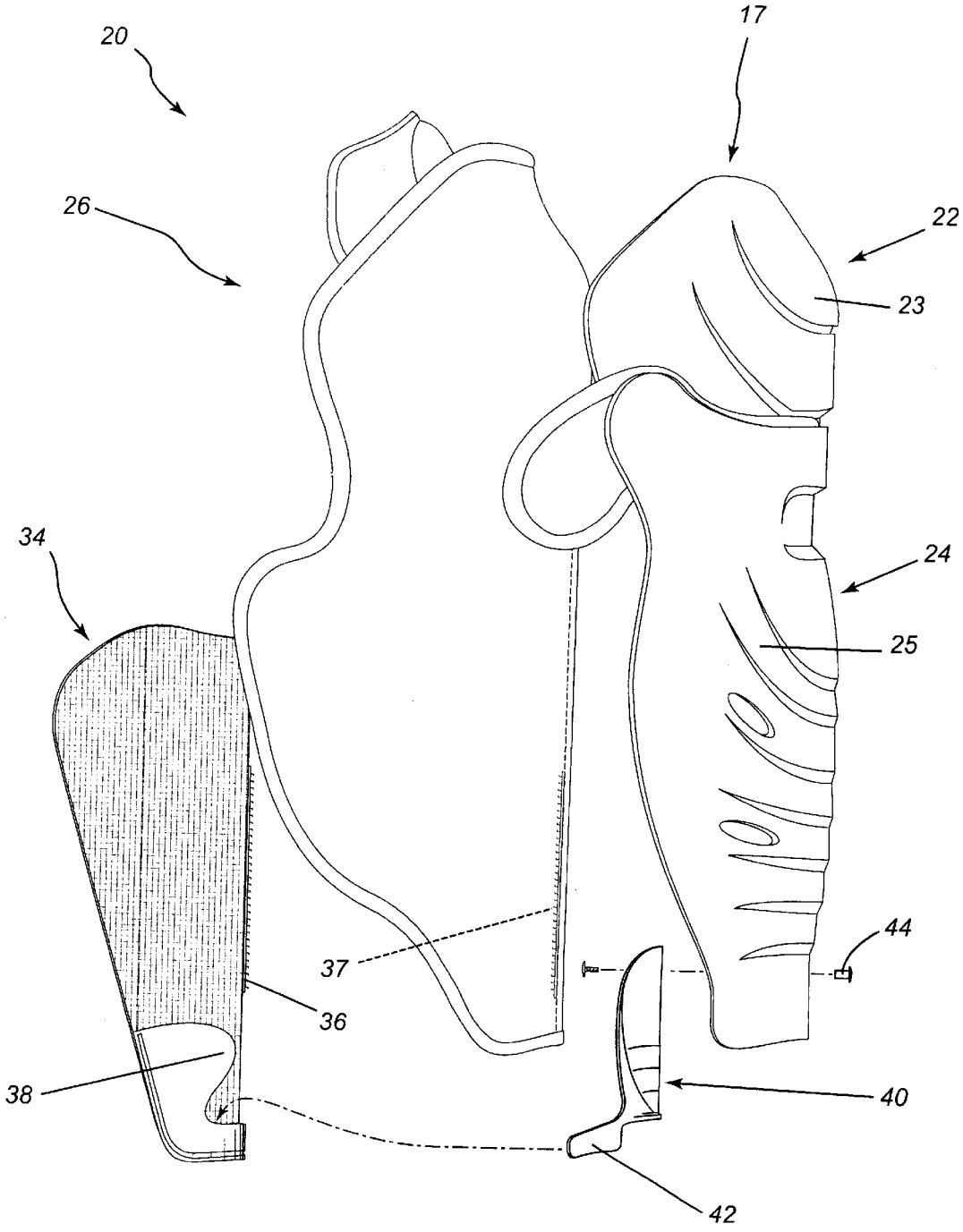
FIG. 1 is an exploded right side view of an exemplary adjustable leg pad assembly constructed in accordance with an embodiment of the invention, the adjustable leg pad assembly being disassembled to show the interrelation of its components.

In the drawings, preferred embodiments of the invention are illustrated by way of examples. It is to be expressly understood that the description and the drawings are only for the purpose of illustration and as an aid to understanding. They are not intended to be a definition of the limits of the invention.

DETAILED DESCRIPTION OF THE PREFERRED EMBODIMENT

With reference to FIG. 1, there is shown a non-limiting example of implementation of the present inventive concept. FIG. 1 shows, in exploded fashion, an adjustable leg pad assembly 20 that comprises a leg pad 17, a shield extension 40, a liner 26, and an adjustable liner 34.

Leg pad 17, more specifically, includes an upper portion 22, a lower portion 24, and an intermediary portion 30. FIG. 1 illustrates that upper portion 22 includes a rigid knee shield 23 that is shaped to overlie and protect the fragile area defined by the knee joint. The lower portion 24 includes a rigid shin shield 25 that is generally made of the same material (i.e., polystylene and the like) as is rigid knee shield 23, and which overlies the user's shin. More specifically, rigid shin shield 25 extends from the lower front portion of the user's ankle to the lower portion of the knee joint. In order to ensure that a more complete level of protection is offered to the user, rigid knee shield 23 and rigid shin shield 25 slightly overlap one another and are connected to one another via intermediary portion 30. Intermediary portion 30, more precisely, is made of supple material such as to enable for a broader range of relative motion between upper portion 22 and lower portion 24.

As depicted in FIG. 1, adjustable leg pad assembly 20 also comprises a liner 26 which is shaped in such a manner as to underlie leg pad 17. Liner 26 is typically made of a supple material such as a polyethylene foam which conforms itself to the anatomy of the wearer and acts to dampen any blows that might occur in the knee joint and shin regions of the wearer. Moreover, the supple nature of liner 26 and the presence of intermediary portion 30 both act to enhance the mobility of adjustable leg pad assembly 20 when the latter is in use. As corroborated by the drawings, liner 26 is also slightly oversized with respect to leg pad 17 in order to further envelop and protect the knee and shin areas of the user without unnecessarily hindering the latter's mobility. On its inner surface, liner 26 also includes an elongated loops type fastener 37 whose purpose will be described in greater detail with reference to a later figure.

Figure 2:
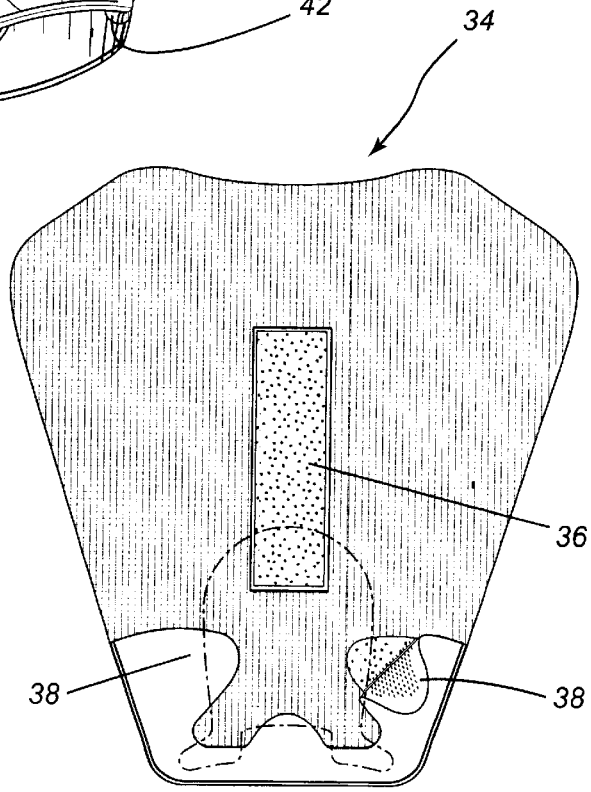
FIG. 2 is a front elevational view of an adjustable liner as depicted in FIG. 1.

FIG. 1 further shows that adjustable leg pad assembly 20 comprises an adjustable liner 34 and a shield extension 40. Adjustable liner 34 is typically slightly shorter than or of approximately the same length as is rigid shin shield 25. Moreover, as shown in FIG. 2, adjustable liner 34 is of a generally truncated V-shape whose width progressively decreases from one end to another (i.e., from its top end to its bottom end), thereby allowing for better conformity with the anatomy (i.e., with the calf) of the user. On its outer surface, adjustable liner 34 features an elongated hooks type fastener 36 which enables it to be coupled with the correspondingly shaped loops type fastener 37 located on the inner surface of liner 26. Although the figures show a specifically shaped adjustable liner 34 and specifically shaped and disposed hooks and loops fasteners 36 and 37, it should be expressly understood that adjustable liners of any shape such as for example of rectangular shape, do not detract from the spirit of the invention. Furthermore, hooks and loops type fasteners of different numbers and shapes also remain within the scope of the invention, as do their respective dispositions on the various components of adjustable leg pad assembly 20. The use of fasteners other than of the hooks and loops type (e.g., rivets, buttons, etc.) also remains within the spirit of the invention.

Figure 4:
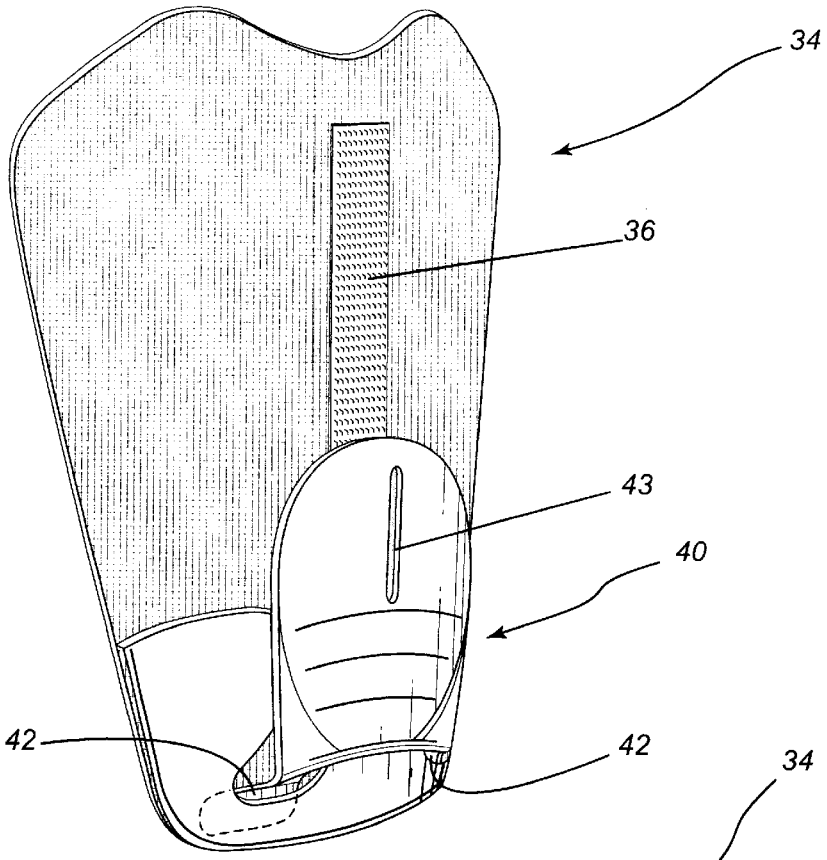
FIG. 4 is a perspective view of the adjustable liner of FIG. 2 and the shield extension of FIG. 3 when coupled.
Figure 3:
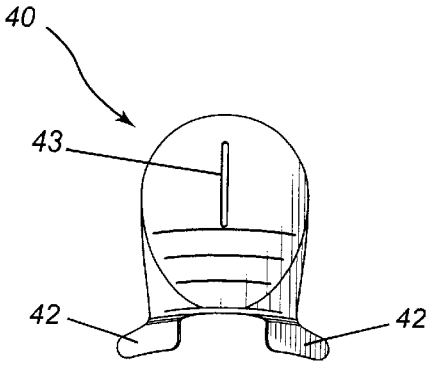
FIG. 3 is a front elevational view of a shield extension as depicted in FIG. 1.

As shown in FIG. 2, adjustable liner 34, at its lower right and left extremities, includes a pair of fastening flaps 38 on its outer surface. One of the fastening flaps 38 shown in the figure is shown partially peeled away in order to better show its features. Fastening flaps 38, more precisely, are composed of a specifically shaped flap of material that includes hooks and loops type fasteners that are adapted to register with one another such that they are in an overlying relationship when coupled. The purpose of fastening flaps 38 is to enable the mounting of shield extension 40 onto adjustable liner 34. Shield extension 40, which is illustrated in greater detail in FIG. 3, is generally made of a rigid material such as polystylene and the like and is transversely curved such to better follow the contour of adjustable liner 34, and hence that of the wearer's leg, when adjustable leg pad assembly 20 is in use. At its lower extremity, shield extension 40 features an inwardly projecting flange from which depend a pair of prongs 42. Prongs 42, which are located at the lowermost right and left extremities of shield extension 40, are shaped in such a manner as to enable their insertion into recesses created when fastening flaps 38 are peeled away. More specifically, the user need only fold back fastening flaps 38, insert prongs 42 into their corresponding recesses, and then replace fastening flaps 38 back into their original arrangement. As a result, shield extension 40, as shown in FIG. 4, is secured to adjustable liner 34. It should be noted that flaps 38 allow the insertion of shield extension 40 into the recesses without having to bend the body of the latter. In an alternative embodiment which isn't shown in the figures, shield extension 40 is permanently mounted onto adjustable liner 34. In such an embodiment, prongs 42 can, for example, be sewn or adhered within the corresponding recesses of adjustable liner 34.

Figure 5:
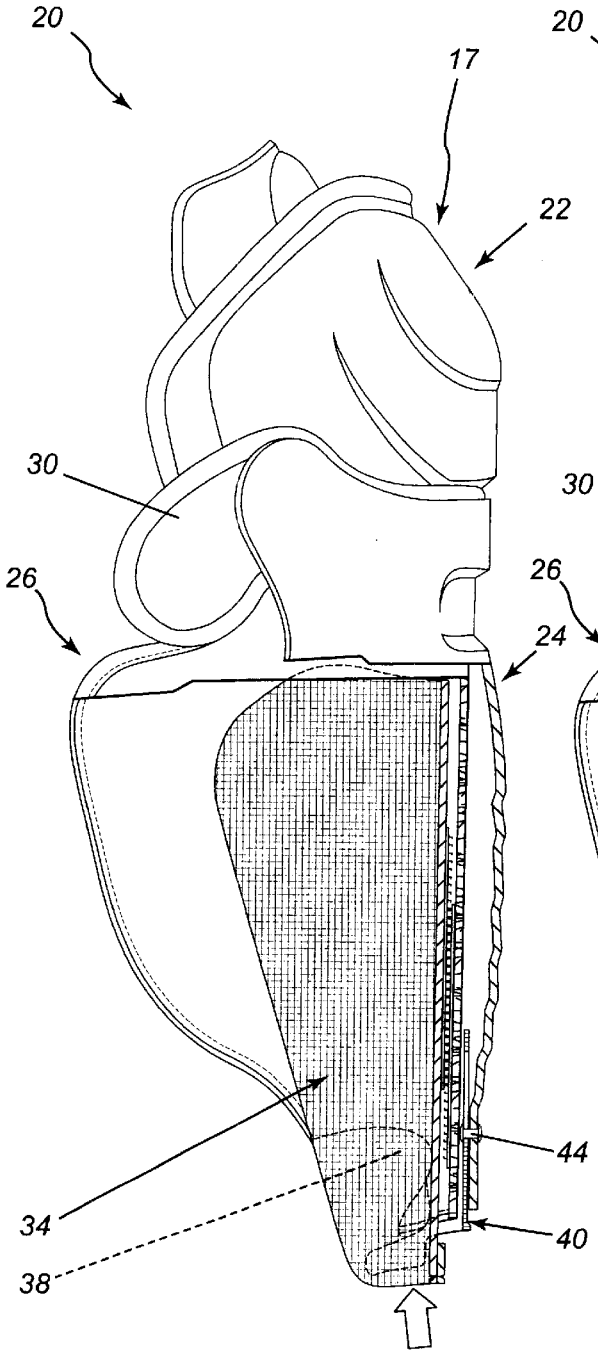
FIG. 5 is a right side elevational view of the adjustable leg pad assembly of FIG. 1 with a portion thereof broken away and a partial cross-sectional view of the lower portion; the adjustable leg pad assembly being shown in a contracted state.
Figure 6:
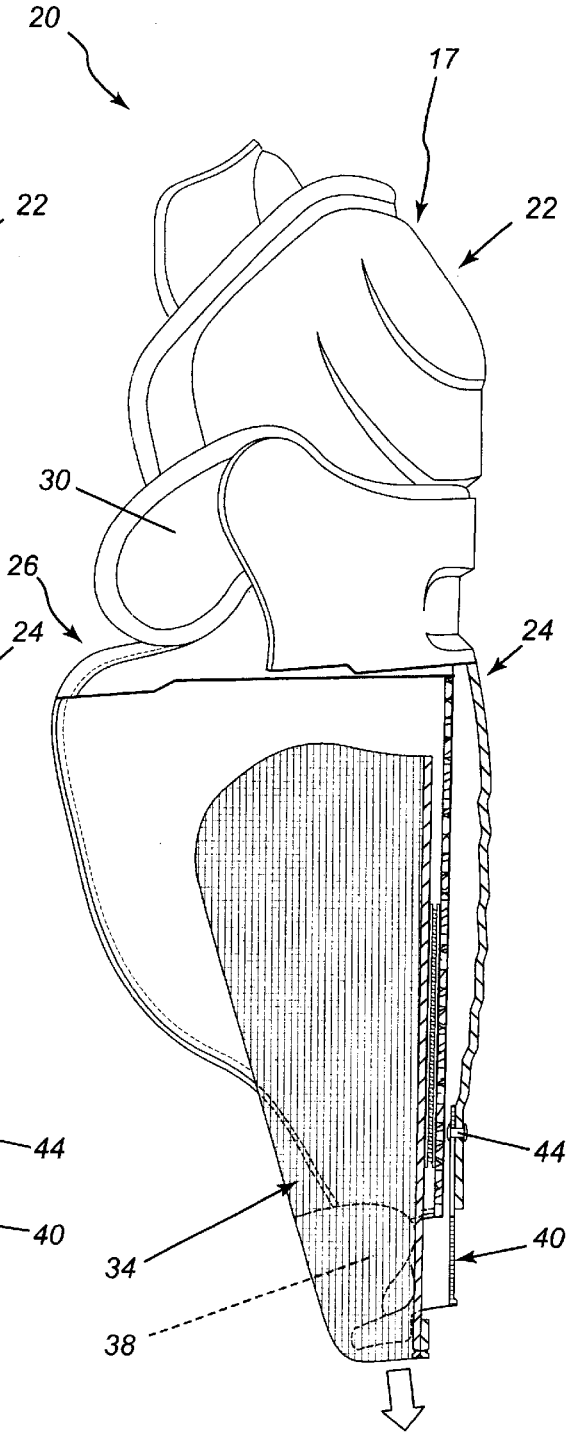
FIG. 6 is a right side elevational view of the adjustable leg pad assembly of FIG. 1 with a portion thereof broken away and a partial cross-sectional view of the lower portion; the adjustable leg pad assembly being shown in an extended state.
Figure 7:
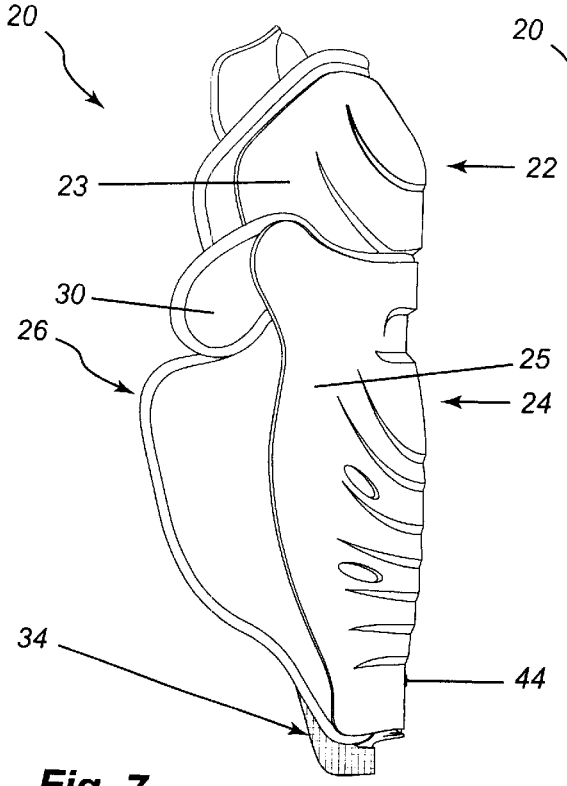
FIG. 7 is a right side elevational view of the adjustable leg pad assembly of FIG. 1; the adjustable leg pad assembly being shown assembled in a contracted state.
Figure 8:
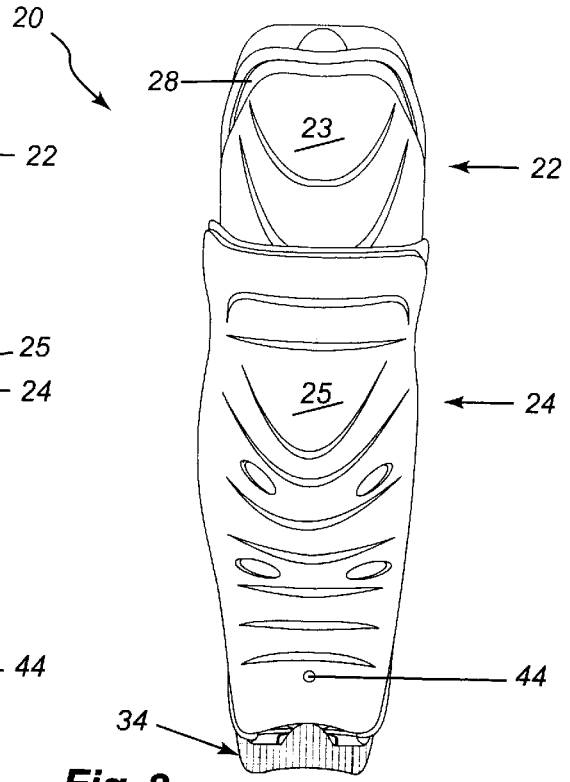
FIG. 8 is a front elevational view of the adjustable leg pad assembly of FIG. 7, in the same contracted state.
Figure 9:
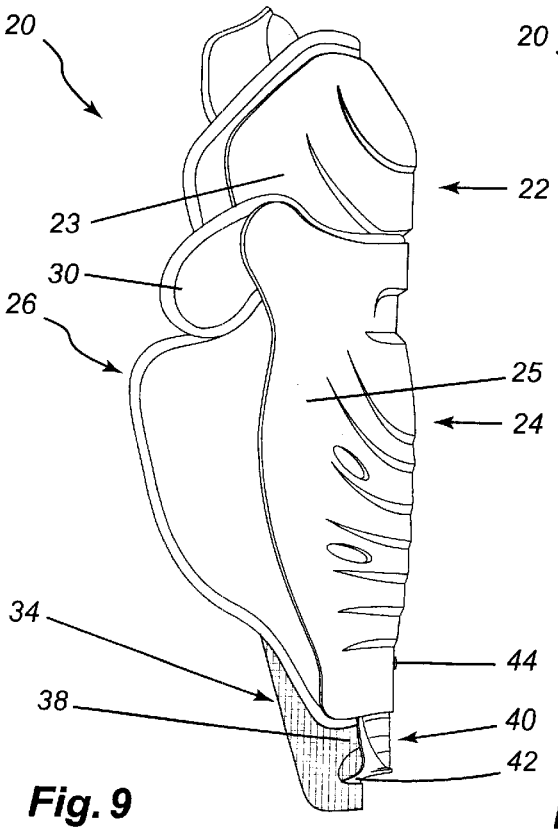
FIG. 9 is a right side elevational view of the adjustable leg pad assembly of FIG. 1; the adjustable leg pad assembly being shown assembled in an extended state.
Figure 10:
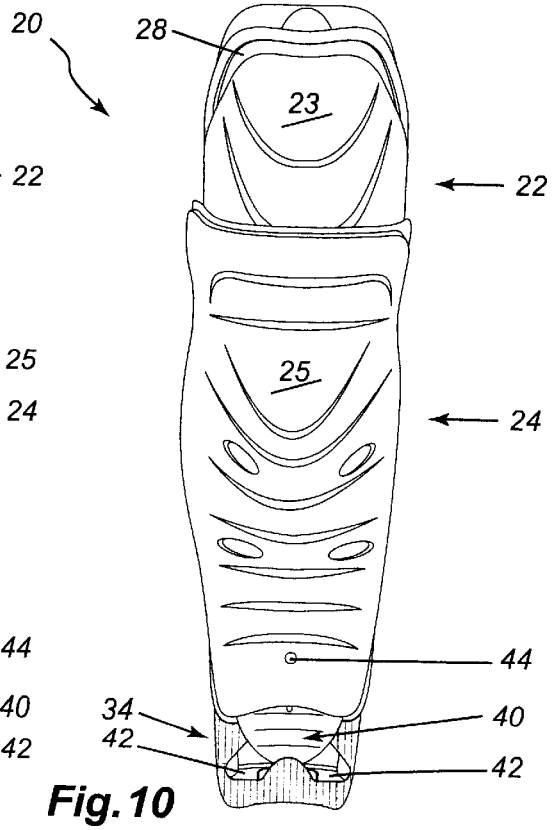
FIG. 10 is a front elevation view of the adjustable leg pad assembly of FIG. 9, in the same extended state.

Shield extension 40 also includes a longitudinally extending slot 43 in the proximity of its center. As shown in FIG. 1, slot 43 is adapted to slidingly receive therein a conventional fastener 44 such as a rivet, a screw, and so on, whose function will be described hereinafter. FIGS. 5 and 6, more precisely, depict adjustable leg pad assembly 20 in its assembled state. The figures also show the interrelation of adjustable liner 34, liner 26, shield extension 40, and leg pad 17. When assembled, shield extension 40, which is secured to adjustable liner 34, is in turn secured to rigid shin shield 24 via fastener 44. Moreover, the upper portion of adjustable liner 34 is also secured to an inner surface of liner 26 by means of their respective hooks and loops type fasteners 36, 37. FIGS. 5 and 6 further depict the adjustable nature of adjustable leg pad assembly 20. FIG. 5, more specifically, shows adjustable leg pad assembly 20 in its most contracted state while FIG. 6 shows it in its most extended state. In order to change the length of adjustable leg pad assembly 20, the user need only grasp adjustable liner 34 and pull it away from liner 26 such as to disengage the hooks and loops fasteners 36, 37 and then slide shield extension 40, and hence adjustable liner 34, in the direction of the arrows such that the desired length is attained, and then reengage the hooks and loops fasteners 36, 37. Fastener 44 therefore also acts to guide the relative positioning of shield extension 40 and shin shield 25 with respect to one another. In addition, the elongated shape of hooks and loops fasteners 36, 37 allow for a certain leeway during the engagement process. Because of this leeway, the lower portion of adjustable leg pad assembly 20 is flexible and may slightly move upward when shield extension 40 abuts against the user's ankle. This flexibility prevents shield extension 40 from digging into the user's ankle and provides for a more comfortable leg pad. It also allows the user to adjust leg pad assembly 20 to a length slightly longer than a normal rigid leg pad.

Moreover, as stated previously, fastener 44 is capable of reciprocal motion within slot 43 and the total adjustment in length therefore permissible by adjustable leg pad assembly 20 is a function of the length of slot 43. Although slots 43 of any length remain within the scope of the invention, slots 43 having a length of approximately 1.5 inches are generally preferred. It should also be noted that although the figures depict a single fastener 44 which is adapted to reciprocate within slot 43, any number of a specific type of fastener (i.e., rivet, screw, etc.) as well as combinations of different types of fasteners that are adapted to act in conjunction with one another remain within the scope of the invention.

FIGS. 7 to 10 depict the adjustable leg pad assembly when ready for use by a wearer. As corroborated by FIGS. 7 and 8, shield extension 40 is virtually entirely concealed when adjustable leg pad assembly 20 is in its most contracted state. In contrast, extending the adjustable leg pad assembly 20 has the effect of progressively revealing shield extension 40. Although the foregoing figures generally depict adjustable leg pad assembly 20 in its two extreme states (i.e., a fully contracted state and a fully extended state), it should be clearly understood that the above-described arrangement permits the user to select from numerous intermediary conditions between both extremes. In fact, the user is able to precisely adjust the length of adjustable leg pad assembly 20 to the exact length he or she wishes and this for each leg. The combination of adjustable liner 34 and shield extension 40 allows an infinite number of length of leg pad assembly within the range of maximum and minimum length.

The above description of preferred embodiments should not be interpreted in a limiting manner since other variations, modifications and refinements are possible within the spirit and scope of the present invention. The scope of the invention is defined by the appended claims and their equivalents.

What is claimed is:

1. An adjustable leg pad assembly for playing hockey and similar sporting activities, said adjustable leg pad assembly comprising:

(a) a knee shield;

(b) a shin shield;

(c) an intermediary portion positioned between said knee shield and said shin shield;

(d) a liner fixedly connected to said knee shield and said shin shield and said intermediary portion;

(e) a shield extension adjustably mounted on an interior portion of said shin shield and extending from a lower portion of said shin shield;

(f) an adjustable liner releasably mounted to said liner, said adjustable liner including connection means to enable the coupling of said shield extension to said adjustable liner; and (g) fasteners for joining said adjustable liner and said liner, said fasteners varying the positioning of said liner and said adjustable liner relative to one another.

2. An adjustable leg pad assembly as defined in claim 1, wherein said adjustable liner and said shield extension are concurrently movable relative to said liner and said shin shield.

3. An adjustable leg pad assembly as defined in claim 1, wherein said shield extension includes at least one prong.

4. An adjustable leg pad assembly as defined in claim 3, wherein said connection means include at least one fastening flap capable of being folded back to define a recess wherein said at least one prong is capable of being inserted thereby effecting the coupling of said adjustable liner and said shield extension.

5. An adjustable leg pad assembly as defined in claim 1, wherein said fasteners include hooks and loops fasteners.

6. An adjustable leg pad assembly as defined in claim 5, wherein said hooks fasteners are disposed along an outer surface of said adjustable liner and said loops fasteners are disposed along an inner surface of said liner.

7. An adjustable leg pad assembly as defined in claim 6, wherein said hooks and loops fasteners are of elongated shape.

8. An adjustable leg pad assembly as defined in claim 1, further comprising guiding means to direct the relative positioning of said shield extension and said shin shield.

9. An adjustable leg pad assembly as defined in claim 8, wherein said guiding means include a slot located on said shield extension, said slot being adapted to slidably receive therein a projection extending from said shin shield, said projection when moving within said slot thereby varying the positioning of said adjustable liner and said shield extension relative to that of said shin shield.

10. An adjustable leg pad assembly as defined in claim 9, wherein said shield extension is substantially rigid.

11. An adjustable leg pad assembly for playing hockey and similar sporting activities, said adjustable leg pad assembly comprising:

(a) a leg pad;

(b) a liner fixedly connected to said leg pad;

(c) a shield extension adjustably mounted on an interior portion of said leg pad and extending from a lower portion of said leg pad;

(d) an adjustable liner releasably mounted to said liner, said adjustable liner including connection means to enable the coupling of said shield extension to said adjustable liner; and (e) fasteners for joining said adjustable liner and said liner, said fasteners varying the positioning of said liner and said adjustable liner relative to one another.

12. An adjustable leg pad assembly as defined in claim 11, wherein said adjustable liner and said shield extension are concurrently movable relative to said liner and said shin shield.

13. An adjustable leg pad assembly as defined in claim 11, wherein said shield extension includes at least one prong.

14. An adjustable leg pad assembly as defined in claim 13, wherein said connection means include at least one fastening flap capable of being folded back to define a recess wherein said at least one prong is capable of being inserted thereby effecting the coupling of said adjustable liner and said shield extension.

15. An adjustable leg pad assembly as defined in claim 14, wherein said fasteners include hooks and loops fasteners.

16. An adjustable leg pad assembly as defined in claim 15, wherein said hooks fasteners are disposed along an outer surface of said adjustable liner and said loops fasteners are disposed along an inner surface of said liner.

17. An adjustable leg pad assembly as defined in claim 16, wherein said hooks and loops fasteners are of elongated shape.

18. An adjustable leg pad assembly as defined in claim 11, further comprising guiding means to direct the relative positioning of said shield extension and said leg pad.

19. An adjustable leg pad assembly as defined in claim 18, wherein said guiding means include a slot located on said shield extension, said slot being adapted to slidably receive therein a projection extending from said leg pad, said projection when moving within said slot thereby varying the positioning of said adjustable liner and said shield extension relative to that of said leg pad.

20. An adjustable leg pad assembly as defined in claim 19, wherein said shield extension is substantially rigid.

21. An adjustable leg pad assembly for playing hockey and similar sporting activities, said adjustable leg pad assembly comprising:

(a) a knee shield;

(b) a shin shield;

(c) an intermediary portion connected to both said knee shield and said shin shield;

(d) a liner fixedly connected to said knee shield and said shin shield and said intermediary portion;

(e) a shield extension adjustably mounted on an interior portion of said shin shield and extending from a lower portion of said shin shield; and (f) an adjustable liner releasably mounted to said liner, said adjustable liner including connection means to enable the coupling of said shield extension to said adjustable liner.

22. An adjustable leg pad assembly for playing hockey and similar sporting activities, said adjustable leg pad assembly comprising:

(a) a leg pad;

(b) a liner fixedly connected to said leg pad;

(c) a shield extension adjustably mounted on an interior portion of said leg pad and extending from a lower portion of said leg pad; and (d) an adjustable liner upon which said shield extension is integrally mounted, said adjustable liner being releasably mounted onto said liner by fasteners, said fasteners varying the positioning of said liner and said adjustable liner relative to one another.

* * * * *